US006688544B2

(12) United States Patent
Rader

(10) Patent No.: US 6,688,544 B2
(45) Date of Patent: Feb. 10, 2004

(54) PACKAGE OF MATERIAL AND PROCESS FOR UNWINDING THE SAME

(75) Inventor: James R. Rader, Cohutta, GA (US)

(73) Assignee: Mohawk Carpet Corporation, Calhoun, GA (US)

( * ) Notice: Subject to any disclaimer, the term of this patent is extended or adjusted under 35 U.S.C. 154(b) by 16 days.

(21) Appl. No.: 10/098,084

(22) Filed: Mar. 14, 2002

(65) Prior Publication Data

US 2003/0183713 A1 Oct. 2, 2003

(51) Int. Cl.[7] ..... B65H 55/04; B65H 49/38
(52) U.S. Cl. ..... 242/178; 242/593
(58) Field of Search ..... 242/178, 480.4, 242/593

(56) References Cited

U.S. PATENT DOCUMENTS

| | | | | |
|---|---|---|---|---|
| 952,005 A | | 3/1910 | Fetherolf | |
| 2,216,034 A | | 9/1940 | Jaeger et al. | |
| 2,846,156 A | | 8/1958 | Flanagan | |
| 3,371,877 A | * | 3/1968 | Klink et al. | 242/472.8 |
| 3,632,062 A | * | 1/1972 | Sole | 242/147 R |
| 4,253,228 A | | 3/1981 | Easley | |
| 4,462,558 A | * | 7/1984 | Stahlecker et al. | 242/178 |
| 4,542,618 A | | 9/1985 | Lossa | |
| 5,046,673 A | | 9/1991 | Moussalli | |

FOREIGN PATENT DOCUMENTS

| | | | |
|---|---|---|---|
| JP | 06079348 A | * | 3/1994 |

* cited by examiner

*Primary Examiner*—Michael R. Mansen
(74) *Attorney, Agent, or Firm*—Troutman Sanders LLP; Gerald R. Boss; Joseph M. Lewinski

(57) ABSTRACT

A package of material for unwinding from a flush end. The package of material includes an elongated winding member to receive a continuous strand of material substantially normal to an axis of the elongated winding member. The continuous strand of material wound about the elongated winding member substantially covers at least one of two ends of the winding member to define a flush end of the package of material. The covered end of the winding member does not protrude beyond the continuous strand of material wound on the winding member. The continuous strand of material is to be unwound over the flush end in a substantially parallel misaligned manner relative to the axis of the elongated winding member. The continuous strand of material being unwound from the elongated winding member is free of obstruction from the covered end of the winding member.

8 Claims, 5 Drawing Sheets

PACKAGE OF MATERIAL AND PROCESS FOR UNWINDING THE SAME

TECHNICAL FIELD

The present invention relates to the use of materials such as yarn and, more particularly, relates to the unwinding of yarn during the tufting process of manufacturing floor covering material, such as carpets and rugs.

BACKGROUND OF THE INVENTION

The use of materials such as yarn to manufacture products such as carpet is a complicated process. To manufacture carpet, numerous spindles of yarn are arranged in a tufting creel. The tufting creel is a structural frame having a plurality of substantially horizontal arms extending outward to receive each spindle of yarn. Each spindle of yarn typically includes a hollow tube through which the arm passes so that the spindle of yarn may hang in the tufting creel. The running ends of each spindle of yarn in the tufting creel are pulled into a tufting machine where the yarn is stitched into carpet. A clutch assembly may be used to adjust the tension of each strand of yarn before the yarn is stitched onto a backing by the tufting machine.

Often a strand of yarn may break as a result of increased tension. When a break occurs, operators spend a significant amount of time locating and repairing the break in the strand of yarn. For example, if a break occurs in the tufting creel, the operator has to locate the spindle of the broken strand of yarn. Additionally, a defect may occur in the carpet requiring an individual to repair the defect by hand. This is a very time consuming process. Also, the defect is not always recognized, resulting in the carpet possibly being sold with the defect in place. In the event the defect is recognized, the carpet will be sold at a reduced price.

Often the operator discovers that the spindle of the broken strand was damaged which prevents the strand of yarn from being unwound with a consistent amount of tension. Typically, the operator discovers damage on an end of the hollow tube about which the yarn is wound. This damage often occurs during shipment. In shipment, numerous spindles of yarn are stacked on a pallet on top of each other end to end. Currently, the yarn is wound onto the tubes wherein the ends of the tube extend beyond the yarn wound onto the tube. Such a design results in the protruding ends of the tube becoming damaged. FIG. 1 illustrates the typical damage that occurs to the end of the hollow tube. As a result of this damage, the yarn being unwound may be snagged by the damaged end of the hollow tube which increases the tension on the snagged strand of yarn causing it to break.

Therefore, there is a need for an improved package of material wherein the material is wound onto the tube in a manner that prevents the ends of the tube from becoming damaged during shipment. The new package of material must prevent the ends of the tube from obstructing the strand of material when being unwound.

SUMMARY OF THE INVENTION

The present invention solves the above-identified problem by providing an improved packaging of yarn and process for unwinding the package of yarn. The present invention allows yarn to be unwound without being obstructed.

Generally described, the present invention includes a package of material having an elongated winding member to receive a continuous strand of material such as yarn. The strand of material is received onto the winding member substantially normal to an axis of the winding member. The continuous strand of material is wound about the elongated winding member in a back and forth manner relative the length of the winding member to cover at least one of the ends of the winding member. The covered end of the elongated winding member does not protrude beyond the continuous strand of material wound onto the winding member.

According to one aspect of the invention, the continuous strand of material is adapted to be unwound over the covered end in a substantially parallel misaligned manner relative to the axis of the winding member. The continuous strand of material when being unwound is free of obstruction from the covered end of the winding member.

The foregoing has broadly outlined some of the more pertinent aspects and features of the present invention. These should be construed to be merely illustrative of some of the more prominent features and applications of the invention. Other beneficial results can be obtained by applying the disclosed information in a different manner or by modifying the disclosed embodiments. Accordingly, other aspects and a more comprehensive understanding of the invention may be obtained by referring to the detailed description of the exemplary embodiments taken in conjunction with the accompanying drawings, in addition to the scope of the invention defined by the claims.

DETAILED DESCRIPTION

Figure 1:
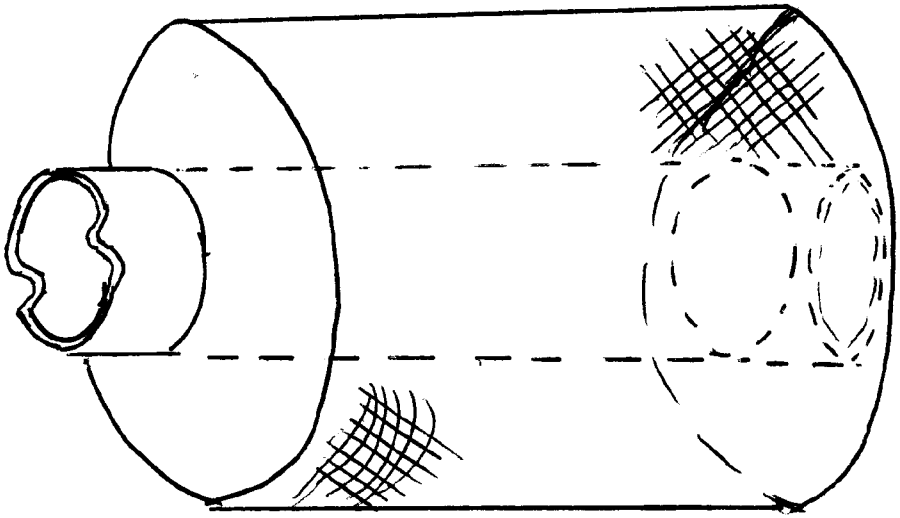
PRIOR ART Fig. 1
FIG. 1 illustrates one embodiment of a prior art package of yarn with the ends of the hollow tube extending out beyond the yarn wound onto the hollow tube.
Figure 2:
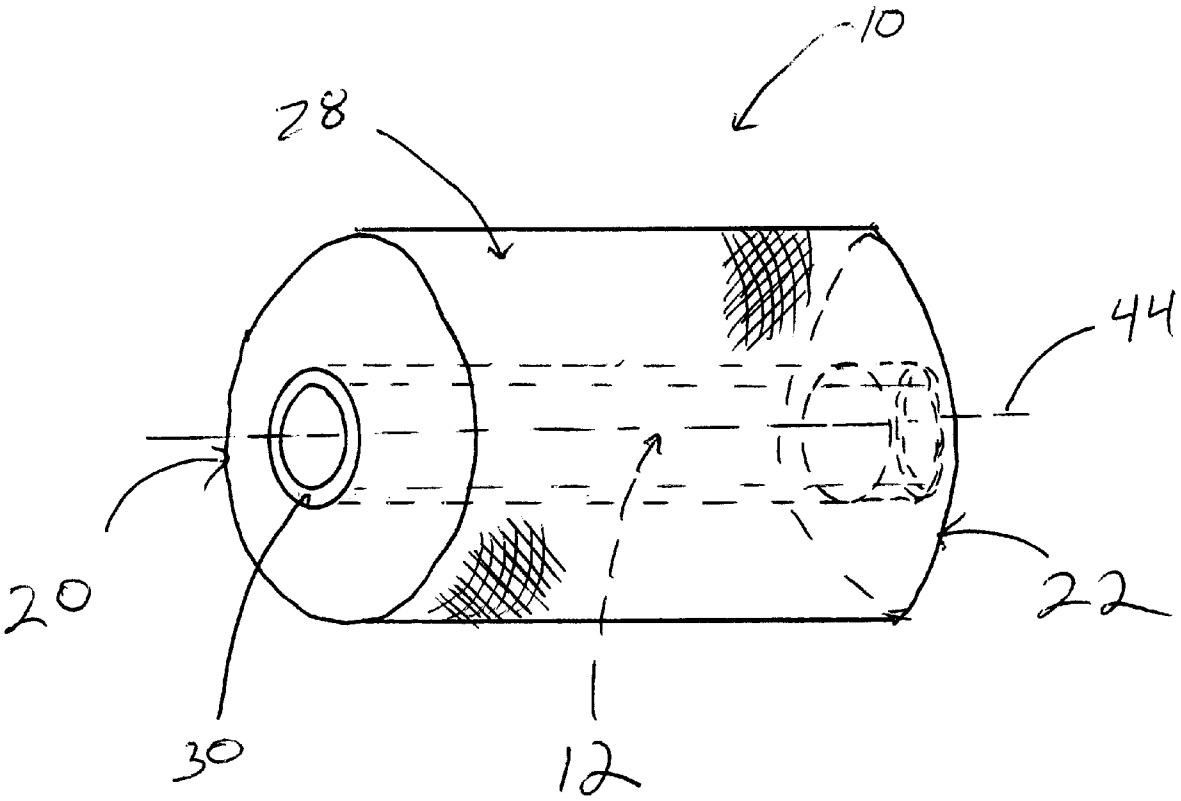
FIG. 2 illustrates a perspective embodiment of the present invention wherein one of the ends of the tube is covered by the yarn so that the covered end does not protrude from the yarn wound onto the hollow tube.

Referring now to the drawings in which like numerals indicate like elements throughout the several views, FIG. 2 illustrates an exemplary embodiment of a package of material 10. The package of material 10 includes a continuous strand of material such as yarn wound by a winding machine (not shown) onto an elongated winding member 12. Although the embodiments described herein are directed toward the use of yarn, the present invention contemplates the use of any type of material in the form of a continuous material which may be wound by a winding machine. The elongated winding member 12 is typically cylindrical with a hollow center therethrough. Preferably, the winding member 12 is a hollow paper or plastic tube. However, the winding member 12 may have any possible configuration suitable for receiving a continuous strand of material. The winding member 12 must also be suitable for use with a tufting creel (not shown).

Figure 3:
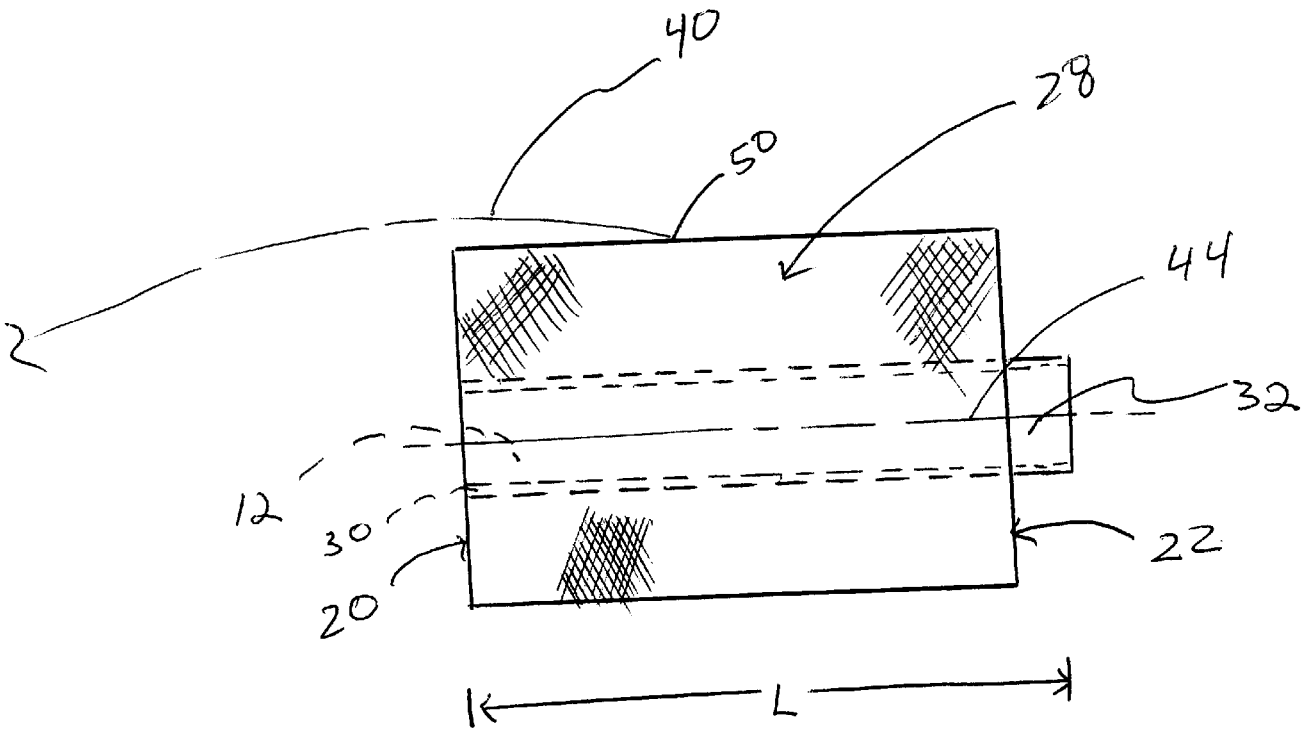
FIG. 3 is a front view of the package of material of FIG. 2.

As best shown in FIGS. 2 and 3, the package of material 10 of the present invention includes a first end 20 and a second end 22. Wound yarn 28 is wound about a length L of the winding member 12 such that an end 30 of the winding member 12 is substantially covered by the wound yarn 28. The end 20 of the package of material 10, when end 30 of the winding member 12 is covered with wound yarn 28, is commonly referred to as a flush end 20. The wound yarn 28 is wound about the winding member 12 in a back and forth manner along the length L of the winding member 12, from end 30 to end 32 of the winding member 12, and vice versa. Preferably, the winding member 12 itself is rotated by the winding machine in order to accumulate the continuous strand of material onto the winding member 12.

In FIG. 3, the end 30 when covered with wound yarn 28 should be contrasted with end 32 of the winding member 12. Because end 32 of the winding member 12 protrudes out from the wound yarn 28, end 22 of the package of material 12 is not a flush end. However, the present invention also includes packages of material 10 wherein both ends 30 and 32 of the winding member 12 are covered by wound yarn 28 to define a pair of opposite flush ends 20, 22. In such case, neither end 30 nor end 32 of the winding member 12 protrudes from the wound yarn 28.

Figure 4:
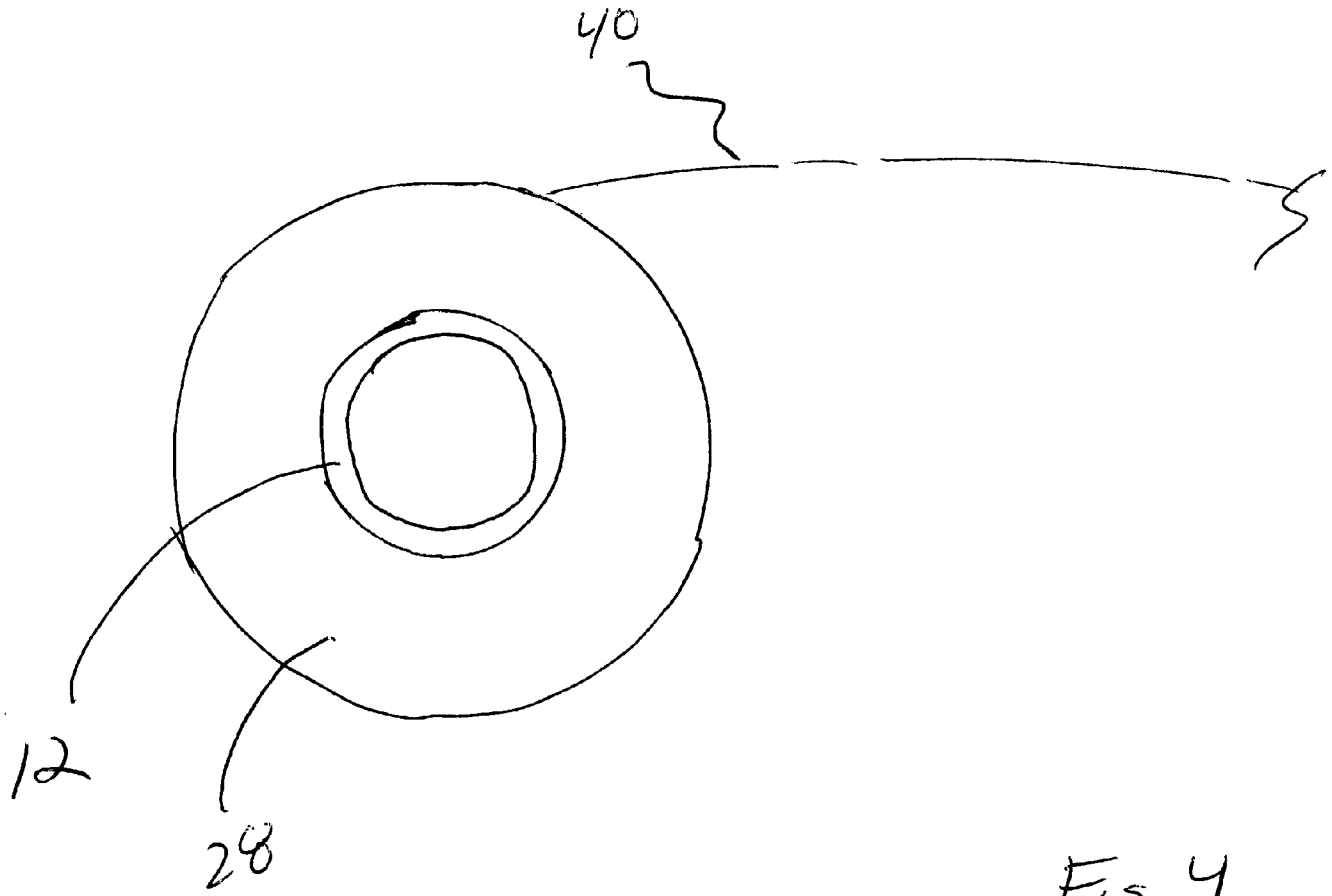
FIG. 4 is an end view of the package of material of FIG. 2.

FIG. 4 best illustrates the manner in which a continuous strand of material 40 is wound onto the winding member 12. The continuous strand of material 40 to be wound onto the winding member 12 is substantially normal to an axis 44 of the winding member 12 to form the wound yarn 28 on the winding member 12. However, as best shown in FIG. 3, the continuous strand of yarn 40, now the unwinding end, is unwound in a manner substantially transverse to the manner in which the continuous strand of material 40 was received onto the winding member 12. Also, the continuous strand of material 40 is unwound from the flush end 20 over the covered end 30 in a substantially parallel misaligned manner relative to the axis 44 of the winding member 12. In other words, even though the winding member 12 and the strand 40 being unwound are substantially parallel, the length of the strand 40 being unwound may be misaligned somewhat relative to winding member 12 because a point 50 at which the strand 40 is being unwound from the wound yarn 28 does not coincide with the ends of the winding member 12.

The continuous strand of material 40 being unwound should be unwound from flush end 20 of the package of material 10 so that the continuous strand of material 40 is unobstructed by the winding member 12. Unwinding the continuous strand of material 40 from the package of material 10 decreases the diameter of the wound yarn 28 along substantially the entire portion of the length L upon which wound yarn 28 has been accumulated. Thus, unwinding the continuous strand of material 40 reduces the diameter of the package of material 10. Because the wound yarn 28 covers the end 30 of the winding member 30, end 30 is not exposed, hindering the winding member 12 from being damaged during shipment. Moreover, because the continuous strand of material 40 being unwound from the package of material 10 is unobstructed by the covered end 30, the continuous strand of material 40 can not be snagged by the winding member 12 which would likely result in a break.

Figure 5:
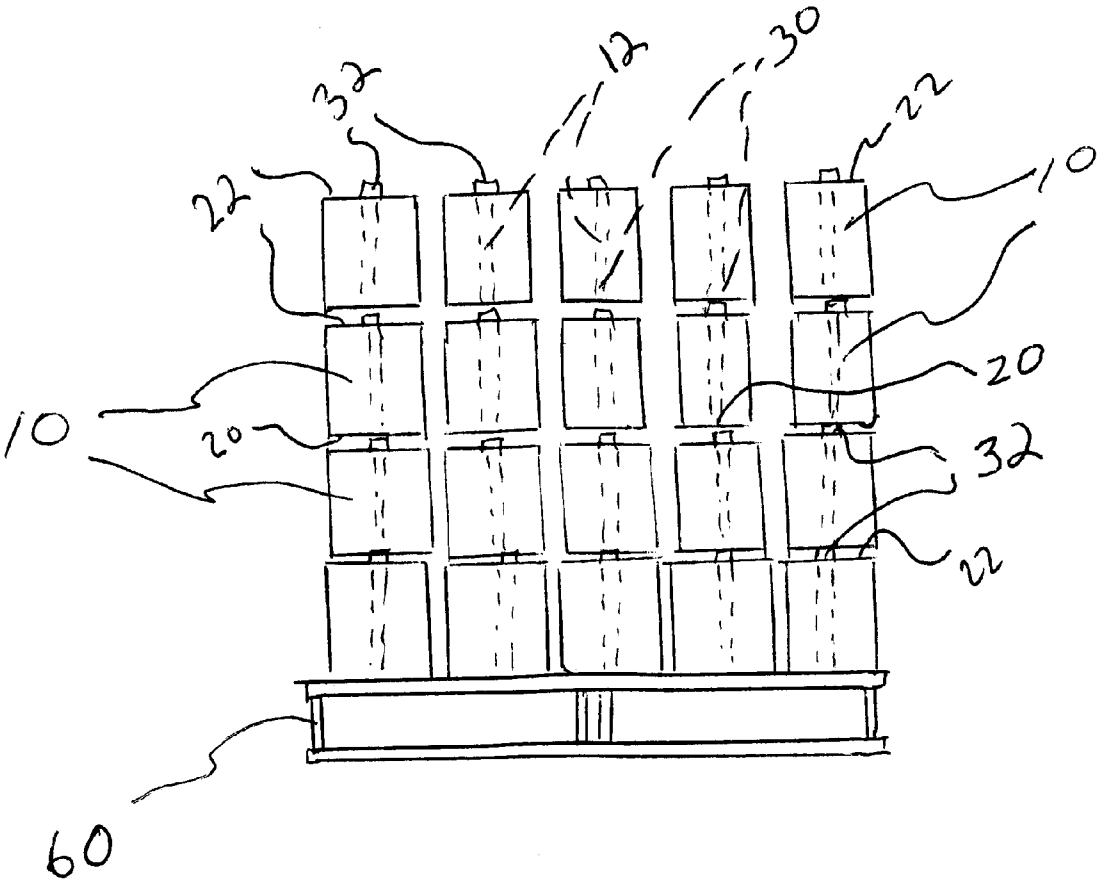
FIG. 5 illustrates one embodiment of a group of packages of material of the present invention arranged on a pallet for shipping.

FIG. 5 illustrates one embodiment of the present invention where a plurality of packages of material 10 is arranged on a shipping pallet 60. Although a particular type of shipping pallet is shown in FIG. 5, the present invention contemplates any type of pallet suitable for shipping a plurality of packages of material 10. As shown in FIG. 5, each package of material 10 is arranged with the winding members 12 aligned end to end. However, the flush end 20 of each package of material 10 abuts an end 32 protruding from another adjacent package of material 10. The packages of material 10 arranged on a pallet 60 as shown in FIG. 5 may be shipped without damaging the covered end 30 of the packages of material 10.

The use of the package of material 10 as described above constitutes an inventive method of the present invention in addition to the package of material 10 itself. In practicing the method of winding and unwinding a continuous strand of material, the steps include receiving the continuous strand of material 40 substantially normal to the axis 44 of the winding member 12. Next, the method includes the step of winding the continuous strand of material 40 onto the elongated winding member 12 in a back and forth manner relative the length L of the winding member. The method also includes the step of covering at least one of the ends 30, 32 of the winding member 12 to define a flush end of the package of material 10 so that either the end 30 or 32, covered by the wound yarn 28, does not protrude from the wound yarn 28 on the winding member 12.

The method of the present invention may also include the steps of unwinding the continuous strand of material 40 over the flush end 20 of the package of material 10 in substantially a parallel misaligned manner relative to the axis 44 of the winding member 12, and then maintaining the continuous strand of material 40 being unwound from the winding member 12 free of obstruction from the end 30 of the winding member 12 covered by the wound yarn 28.

The method of the present invention may also include the steps of rotating the winding member 12 in order to accumulate the continuous strand of material 40 onto the winding member 12. Another step of the method of the present invention may include arranging a plurality of packages of material 10 onto a pallet 60 for shipment, as described above.

The present invention has been illustrated in relation to particular embodiments which are intended in all respects to be illustrative rather than restrictive. Those skilled in the art will recognize that the present invention is capable of many modifications and variations without departing from the scope of the invention. Accordingly, the scope of the present invention is described by the claims appended hereto and supported by the foregoing.

What is claimed is:

1. An article of manufacture, comprising:

an elongated winding member having a first end and a second end;

a continuous strand of material wound about said elongated winding member in a back and forth manner substantially normal to an axis of said elongated winding member so that said continuous strand of material forms a winding about said elongated member, the winding and elongated member defining a package, the winding substantially covering the first end of said elongated winding member such that said first end does not extend beyond the winding, thereby defining a flush end of the package, the winding not covering the second end of the winding member, such that the second end of the elongated winding member protrudes beyond the winding, thereby defining a protruding end of the package, such that said winding may be unwound by pulling said continuous strand over said first end of said elongated winding member in a substantially parallel misaligned manner to the axis of the elongated member without obstruction by said first end of the elongated member.

2. The package of material of claim 1 wherein said elongated winding member is a paper tube.

3. The package of material of claim 1 wherein said elongated winding member is a rotatable winding member wherein said rotatable winding member is rotated to accumulate said continuous strand of material onto said rotatable winding member.

4. A method for packaging a continuous strand of material, comprising the steps of:

receiving said continuous strand of material substantially normal to an axis of an elongated winding member, said elongated winding member having a first end and a second end;

winding said continuous strand of material onto said elongated winding member in a back and forth manner relative a length of said winding member to form a winding of said continuous strand of material, said winding and said winding member defining a package of material;

covering said first end of said winding member to define a flush end of said package of material such that said first end of said winding member does not protrude beyond said winding on said winding member; and not covering said second end of said winding member to define a protruding end of said package of material such that said second end of said winding member protrudes beyond said winding.

5. The method of claim 4 wherein said step of winding said continuous strand of material onto said elongated winding member in a back and forth manner relative a length of said winding member to form the package of material includes the step of rotating said elongated winding member in order to accumulate said continuous strand of material on said elongated winding member.

6. A system for providing material to a machine having a pull feeder which pulls material toward the machine in a feeding direction, comprising:

a package of yarn, comprising, an elongated winding member comprising a hollow paper tube having a first end and a second end, and a continuous strand of yarn wound about said elongated winding member in a manner substantially normal to an axis of said elongated winding member, said wound continuous strand of material defining a winding, the winding covering the first end of said elongated winding member such that said first end of said winding member does not extend beyond the winding, thereby defining a flush end of said package, and said continuous strand of material not covering the second end of said elongated winding member such that said second end of the winding member extends beyond the winding, thereby defining a protruding end of said package; and a substantially horizontal support arm extending through the core of said elongated winding member and supporting said package of material in a substantially horizontal manner such that the flush end of the package is oriented toward the feeding direction of the machine, such that the continuous strand of material is pulled over the flush end in a substantially parallel misaligned manner relative to said axis of said elongated winding member.

7. A method for providing material to a machine having a pull feeder which pulls material toward the machine in a feeding direction, comprising the steps of:

forming a package of material by providing a continuous strand of material wound about an elongated winding member in a manner substantially normal to an axis of said elongated winding member, said elongated winding member being a hollow paper tube having a first end and a second end, said continuous strand of material forming a winding which covers the first end of said winding member thereby defining a flush end of the package, said continuous strand of material not covering said second end of said winding member such that said second end of said elongated winding member protrudes from the continuous strand of material thereby defining a protruding end of the package; and providing said package on a substantially horizontal portion of a support arm such that said support arm passes through said elongated winding member such that said package is substantially horizontal and said flush end of said package is oriented toward the feeding direction, such that said continuous strand of material is pulled from the flush end in a substantially parallel misaligned manner relative to the axis of said elongated winding member without obstruction by the first end of the elongated member, and said protruding end of said elongated member prevents contact between said support arm and said continuous strand of material.

8. A method of preparing a plurality of strands of material for shipment, comprising the steps of:

providing an elongated member for each of said strands;

receiving each of said continuous strands of material on a respective elongated member substantially normal to an axis of the elongated winding member, said elongated winding member having a first end and a second end;

winding each of said plurality of continuous strands of material onto the respective elongated winding member in a back and forth manner relative a length of the winding member to form a winding, said winding and elongated member defining a package of material;

covering said first end of each of each of said winding members to define a flush end of each of said packages of material such that said first end of each of said winding members does not protrude beyond said continuous strand of material accumulated on each of said winding members;

not covering said second end of each of said winding members, thereby defining a protruding end of each of said packages of material such that said second end of said winding member protrudes beyond said continuous strand of material accumulated on said winding member; and providing said plurality of packages of material end to end such that said flush end of one of said plurality of packages of material abuts said protruding end of another of said plurality of packages of material.

* * * * *